US008303065B2

(12) United States Patent
Miyazaki et al.

(10) Patent No.: US 8,303,065 B2
(45) Date of Patent: Nov. 6, 2012

(54) LOAD DRIVING CIRCUIT, LIQUID EJECTION DEVICE, AND PRINTING APPARATUS

(75) Inventors: Shinichi Miyazaki, Suwa (JP); Kunio Tabata, Shiojiri (JP); Atsushi Oshima, Shiojiri (JP); Hiroyuki Yoshino, Matsumoto (JP); Noritaka Ide, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 196 days.

(21) Appl. No.: 12/858,296

(22) Filed: Aug. 17, 2010

(65) Prior Publication Data

US 2011/0043559 A1 Feb. 24, 2011

(30) Foreign Application Priority Data

Aug. 18, 2009 (JP) ..... 2009-188940

(51) Int. Cl.
*B41J 29/38* (2006.01)

(52) U.S. Cl. ..... 347/10

(58) Field of Classification Search ..... 347/9–11, 347/58, 68

See application file for complete search history.

(56) References Cited

U.S. PATENT DOCUMENTS 6,759,766 B2 * 7/2004 Hiratsuka et al. ..... 307/110

FOREIGN PATENT DOCUMENTS

JP 07-130484 5/1995
JP 11-259969 9/1999

* cited by examiner

*Primary Examiner* — An Do
(74) *Attorney, Agent, or Firm* — Maschoff Gilmore & Israelsen

(57) ABSTRACT

A load driving circuit includes first storage elements charged by a power supply and a series storage element group constituting unit that switches the connection state between the first storage elements to constitute a series storage element group in which the first storage elements are connected in series. A second storage element charging unit charges a second storage element using the series storage element group. Switching is performed between first and second connection states to apply voltage to the load. In the first connection state, the charged second storage element and the series storage element group are connected to the load while the second storage element and the series storage element group are connected in series. In the second connection state, the series storage element group is connected to the load while the series connection between the second storage element and the series storage element group is broken.

4 Claims, 9 Drawing Sheets

LOAD DRIVING CIRCUIT, LIQUID EJECTION DEVICE, AND PRINTING APPARATUS

BACKGROUND

1. Technical Field

The present invention relates to a technique of applying a voltage to drive a load.

2. Related Art

A technique of applying a voltage to drive a load of an electronic element such as a semiconductor element or a dielectric element has been widely used in various devices. In a fluid ejection device such as an inkjet printer for example, a voltage is applied to a piezo element that expands and contracts according to a voltage, so that fluid is pushed out of an ejection port and ejected. In a display device such as a liquid crystal display or an organic EL display, a voltage is applied to liquid crystal to align liquid crystal molecules, or a voltage is applied to an organic EL element to cause it to emit light, so that an image is displayed. Moreover, a technique of applying a voltage to drive various loads such as a motor or an electromagnet, in addition to the electronic element, has also been widely used.

In the devices that drive such various loads, the waveform of voltage (voltage waveform) to be applied to the load is controlled to control the operation of the load. Therefore, it is important to accurately generate a voltage waveform. For such a reason, a technique of generating a voltage waveform has been widely used in which a power supply that generates a voltage higher than the maximum voltage of a voltage waveform to be generated is prepared, and the voltage from the power supply is decreased using a semiconductor element such as a power transistor (for example, JP-A-11-259969). In this technique, the power transistor or the like can be controlled to accurately generate a voltage waveform.

Moreover, when a device includes a power supply having a high output voltage or a power transistor having a high withstand voltage, the device tends to be large. Therefore, a technique of using a circuit (so-called charge pump circuit) to omit a power transistor or the like for miniaturizing the device configuration has been proposed (JP-A-7-130484). The circuit charges a plurality of capacitors to the same voltage, connects the capacitors in series to increase the voltage, and changes the number of capacitors to be connected in series to change the voltage.

In the proposed technique, however, there is a problem that generating a highly accurate voltage waveform is difficult. That is, since the voltage is changed by changing the number of capacitors to be connected in series, the number of kinds of voltage values that can be output is limited to the number of capacitors. Since a voltage waveform has to be generated with the limited kinds of voltages, generating a highly accurate voltage waveform is difficult. The enhancement of accuracy of the voltage waveform is of course possible by providing more capacitors to output many kinds of voltages. This time, however, miniaturizing the circuit is difficult because the number of capacitors increases.

SUMMARY

An advantage of some aspects of the invention is to provide a technique of increasing the kinds of voltage values that can be output to enhance the accuracy of a voltage waveform while reducing the number of capacitors.

The invention can employ the following configuration. That is, a first aspect of the invention is directed to a load driving circuit that applies a voltage to a load to drive the load, including: a plurality of first storage elements that are charged by receiving a supply of voltage from a power supply; a series storage element group constituting unit that switches the connection state between the plurality of first storage elements to constitute a series storage element group in which the first storage elements are connected in series; a second storage element charging unit that charges a second storage element different from the first storage elements using the series storage element group; and a voltage applying unit that switches between a first connection state and a second connection state to apply a voltage to the load, the first connection state being a state in which the charged second storage element and the series storage element group are connected to the load while the second storage element and the series storage element group are connected in series, the second connection state being a state in which the series storage element group is connected to the load while the series connection between the second storage element and the series storage element group is broken.

The load driving circuit of the first aspect of the invention includes the plurality of first storage elements charged by the power supply. The plurality of first storage elements are connected in series to constitute the series storage element group. The series storage element group is connected to the second storage element to charge the second storage element. For applying a voltage to the load by connecting the series storage element group to the load, the voltage is applied by switching between the state in which the series storage element group and the charged second storage element are connected to the load while the second storage element and the series storage element group are connected in series and the state in which the series storage element group is connected to the load while the series connection between the second storage element and the series storage element group is broken.

The series storage element group in which the plurality of first storage elements are connected in series generates a voltage different from that of each of the first storage elements. Therefore, the second storage element charged using the series storage element group has a voltage different in voltage value from that of the first storage element. In the case where a voltage is output using the storage elements, the output voltage is different in voltage value between when only the first storage elements are connected in series (when only the series storage element group is used) and when the second storage element is connected in series in addition to the first storage elements (when the second storage element is connected in series to the series storage element group). Thus, since the number of voltages that can be output can be increased, the degree of gradations of the output voltage is improved. As a result, the accuracy of a voltage waveform can be enhanced. The series storage element group can take a plurality of modes each of which is different in the number of first storage elements constituting the series storage element group. Each of the modes can output two kinds of voltages depending on whether or not the series storage element group and the second storage element are connected in series. Therefore, the number of voltages that can be output can be greatly increased only by providing the second storage element, and many kinds of voltages can be output while reducing the number of storage elements.

The storage element may be any element as long as it is charged to generate a voltage. For example, it may be an element that stores an electric field therein when charged and supplied with electric charge to thereby generate a voltage, like a capacitor. Or, it may be an element that stores chemical energy therein to thereby generate a voltage, like a secondary battery.

In the load driving circuit according to the first aspect of the invention, when the first storage elements are disconnected from the load and charged, the second storage element may be connected to the load.

Thus, since the first storage elements can be charged while a voltage is applied to the load using the voltage of the second storage element, the voltage remains applied to the load even when the first storage elements are charged.

The invention can be recognized as the following aspect. That is a second aspect of the invention which is directed to a load driving circuit that applies a voltage to a load to drive the load, including: a first storage element that is charged by receiving a supply of voltage from a power supply; a second storage element that is charged by receiving a supply of voltage from the power supply; a series storage element group constituting unit that constitutes a series storage element group in which the first storage element and the second storage element are connected in series; a third storage element charging unit that charges a third storage element different from the first storage element and the second storage element using the series storage element group; and a voltage applying unit that switches between a first connection state and a second connection state to apply a voltage to the load, the first connection state being a state in which the charged third storage element and the series storage element group are connected to the load while the third storage element and the series storage element group are connected in series, the second connection state being a state in which the series storage element group is connected to the load while the series connection between the third storage element and the series storage element group is broken.

The load driving circuit of the second aspect of the invention includes the first storage element and the second storage element charged by the power supply. The first storage element and the second storage element are connected in series to constitute the series storage element group. The series storage element group is connected to the third storage element to charge the third storage element. For applying a voltage to the load by connecting the series storage element group to the load, the voltage is applied by switching between the state in which the series storage element group and the charged third storage element are connected to the load while the third charged storage element and the series storage element group are connected in series, and the state in which the series storage element group is connected to the load while the series connection between the third storage element and the series storage element group is broken.

The series storage element group in which the first storage element and the second storage element are connected in series generates a voltage different from that of the first storage element and the second storage element. Therefore, the third storage element charged using the series storage element group has a voltage different from that of the first storage element and the second storage element. Accordingly, the output voltage is different between when only the series storage element group is used (when only the first storage element and the second storage element are used) and when the third storage element is connected in series in addition to the series storage element group. Thus, the kinds of voltage values can be increased to improve the degree of gradations of the output voltage. As a result, the accuracy of a voltage waveform can be enhanced.

Since the use of the load driving circuit according to the first aspect of the invention makes it possible to drive an actuator disposed in an ejection nozzle to properly eject liquid from the ejection nozzle, the invention can be recognized as a liquid ejection device including the load driving circuit, which is a third aspect according to the invention.

In the liquid ejection device according to the third aspect of the invention, since a highly accurate voltage waveform is generated by the load driving circuit, the operation of the actuator can be controlled with good accuracy. As a result, the amount of liquid or size of droplet to be ejected, the ejecting speed of liquid, and the like can be controlled with good accuracy to properly eject liquid.

Since the liquid ejection device according to the third aspect of the invention can be mounted on a printing apparatus, the invention can be recognized as a printing apparatus on which the liquid ejection device is mounted, which is a fourth aspect according to the invention.

In the printing apparatus according to the fourth aspect of the invention, an actuator disposed in an ejection nozzle can be driven with good accuracy by the load driving circuit. As a result, since liquid such as ink can be ejected with good accuracy, a high quality image can be printed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, for making clear the contents of the invention, an embodiment of an inkjet printer on which a voltage waveform generator is mounted will be described in the following order.

A. Device Configuration of Inkjet Printer
B. Drive Voltage Waveform Generator of Embodiment
C. MODIFIED EXAMPLES
C-1. First Modified Example
C-2. Second Modified Example
C-3. Third Modified Example
C-4. Fourth Modified Example
C-5. Fifth Modified Example

A. Device Configuration of Inkjet Printer

Figure 1:
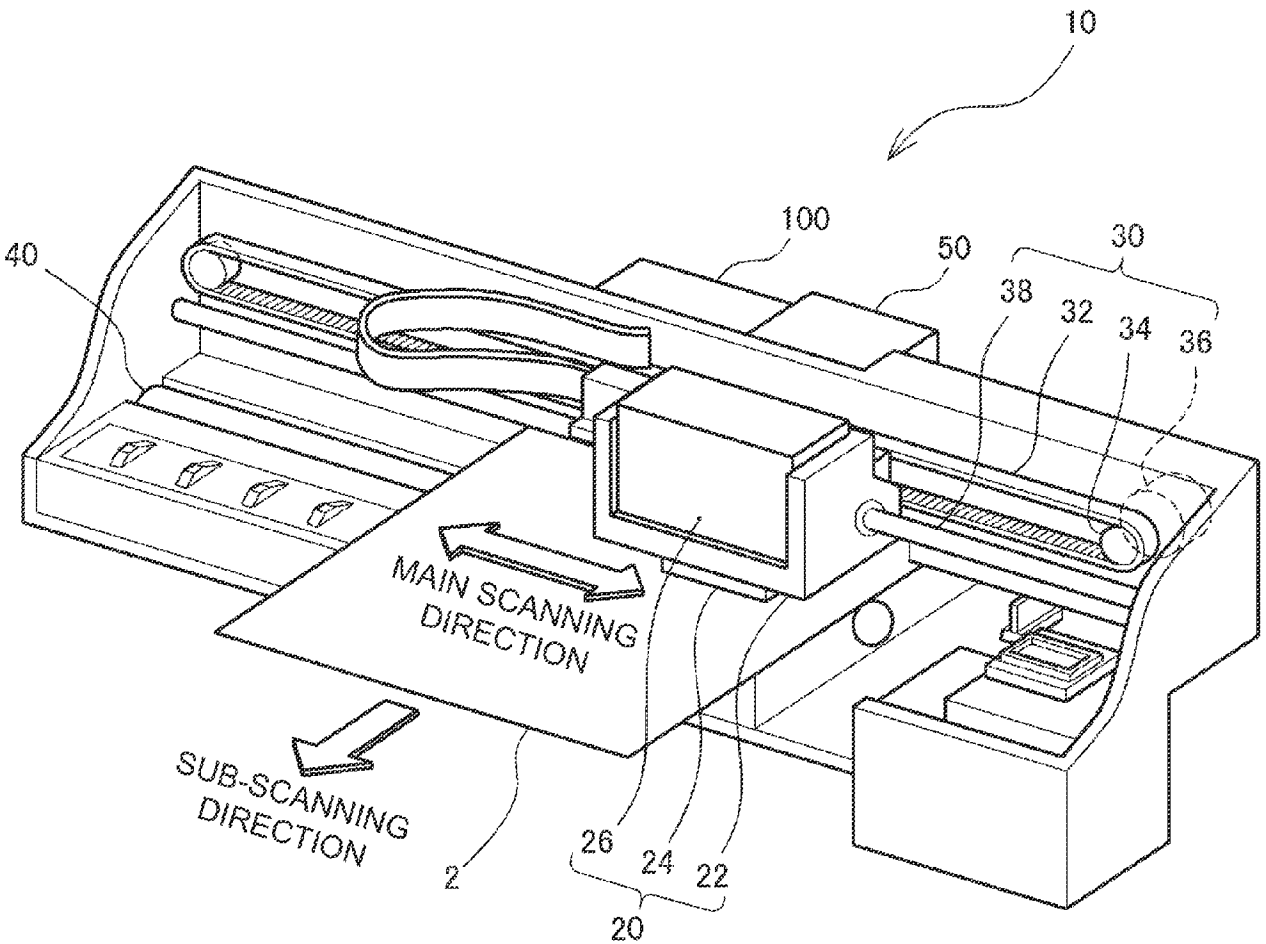
FIG. 1 is an explanatory view schematically showing the configuration of an inkjet printer on which a voltage waveform generator of an embodiment is mounted.

FIG. 1 is an explanatory view schematically showing the configuration of an inkjet printer on which a voltage waveform generator of the embodiment is mounted. As shown in the drawing, the inkjet printer 10 includes a carriage 20 that reciprocates in a main scanning direction to form an ink dot on a print medium 2, a drive mechanism 30 that makes the carriage 20 reciprocate, and a platen roller 40 that feeds the print medium 2. The carriage 20 is provided with an ink cartridge 26 accommodating ink therein, a carriage case 22 into which the ink cartridge 26 is loaded, an ejection head 24 that is mounted on the bottom side (side facing the print medium 2) of the carriage case 22 to eject ink, and the like. The carriage 20 can guide the ink in the ink cartridge 26 to the ejection head 24 and eject a correct amount of ink from the ejection head 24 to the print medium 2.

The drive mechanism 30 that makes the carriage 20 reciprocate includes a guide rail 38 extending in the main scanning direction, a timing belt 32 having a plurality of teeth formed inside thereof, and a drive pulley 34 and a step motor 36 for driving the timing belt 32. A part of the timing belt 32 is fixed to the carriage case 22. By driving the timing belt 32, the carriage case 22 can be moved along the guide rail 38 with good accuracy.

The platen roller 40 is driven by a not-shown drive motor or gear mechanism so that it can feed the print medium 2 in a sub-scanning direction by a predetermined amount. These mechanisms are controlled by a printer control circuit 50 mounted on the inkjet printer 10. Under the control of the printer control circuit 50, the platen roller 40 feeds the print medium 2, and the carriage case 22 causes the ejection head 24 to eject ink while moving in the main scanning direction, whereby an image is printed on the print medium 2.

Figure 2:
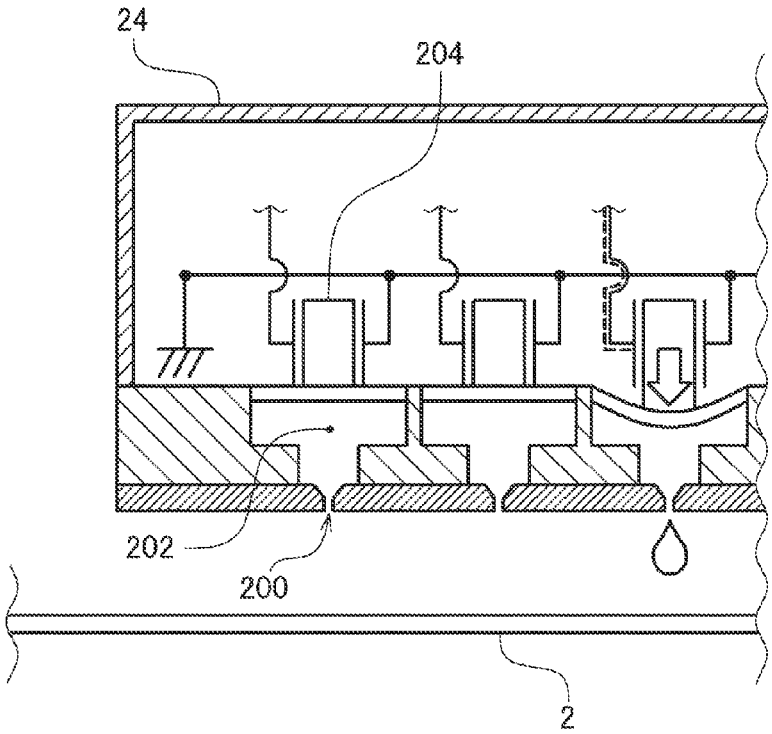
FIG. 2 is an explanatory view showing the internal mechanism of an ejection head in detail.

FIG. 2 is an explanatory view showing the internal mechanism of the ejection head in detail. As shown in the drawing, a bottom surface (surface facing the print medium 2) of the ejection head 24 is provided with a plurality of ejection ports 200. Ink drops can be ejected from each of the ejection ports 200. The ejection port 200 is connected to each of ink chambers 202. The ink chamber 202 is filled with ink supplied from the ink cartridge 26. A piezo element (piezoelectric element) 204 is disposed on the ink chamber 202. When a voltage is applied to the piezo element 204, the piezo element is deformed to pressurize the ink chamber 202, so that the ink drop can be ejected from the ejection port 200. In this case, the piezo element 204 corresponds to a so-called capacitive load as has been well known. Since the deformation amount of the piezo element 204 varies depending on the applied voltage, the size of the ink drop to be ejected can be changed by adjusting the force or timing to press the ink chamber 202 by properly controlling the voltage to be applied to the piezo element 204. Therefore, the inkjet printer 10 applies the following voltage waveform to the piezo element 204.

Figure 3:
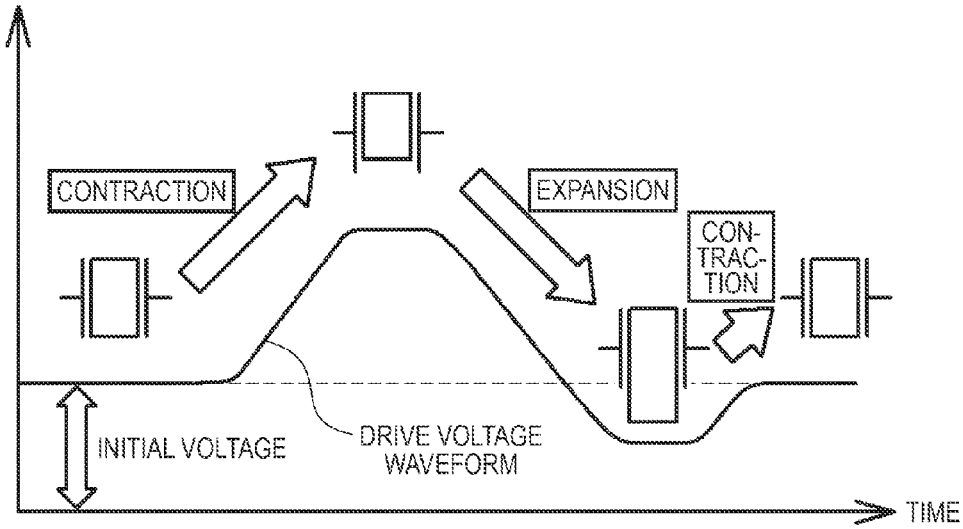
FIG. 3 is an explanatory view illustrating a voltage waveform (drive voltage waveform) to be applied to a piezo element.

FIG. 3 is an explanatory view illustrating a voltage waveform (drive voltage waveform) to be applied to the piezo element. As shown in the drawing, the drive voltage waveform has a trapezoidal shape in which the voltage is increased with elapse of time, and then is decreased to its original voltage. FIG. 3 also shows the piezo element 204 that expands and contracts according to the drive voltage waveform. As shown in the drawing, when the voltage of drive voltage waveform is increased, the piezo element 204 is gradually contracted correspondingly. In this case, since the ink chamber 202 is pulled by the piezo element 204 and thus expanded, the ink can be supplied from the ink cartridge 26 into the ink chamber 202. When the voltage is increased to reach its peak and thereafter is decreased, the piezo element 204 is expanded this time to compress the ink chamber 202, so that ink is ejected from the ejection port 200. In this case, the drive voltage waveform drops to a voltage lower than the original voltage (voltage indicated as "initial voltage" in the drawing), so that the piezo element 204 can be expanded more than the initial state to sufficiently push the ink out. Thereafter, the drive voltage waveform returns to the initial voltage, and the piezo element 204 also returns to the initial state correspondingly.

In this manner, the inkjet printer 10 is provided with the piezo element 204 in the ink chamber 202 and can eject ink drops from the ejection head 24 by applying a proper drive voltage waveform to the piezo element 204. Therefore, the inkjet printer 10 includes a drive voltage waveform generator 100 generating the drive voltage waveform, in addition to the printer control circuit 50 controlling the operation of the mechanisms.

Figure 4:
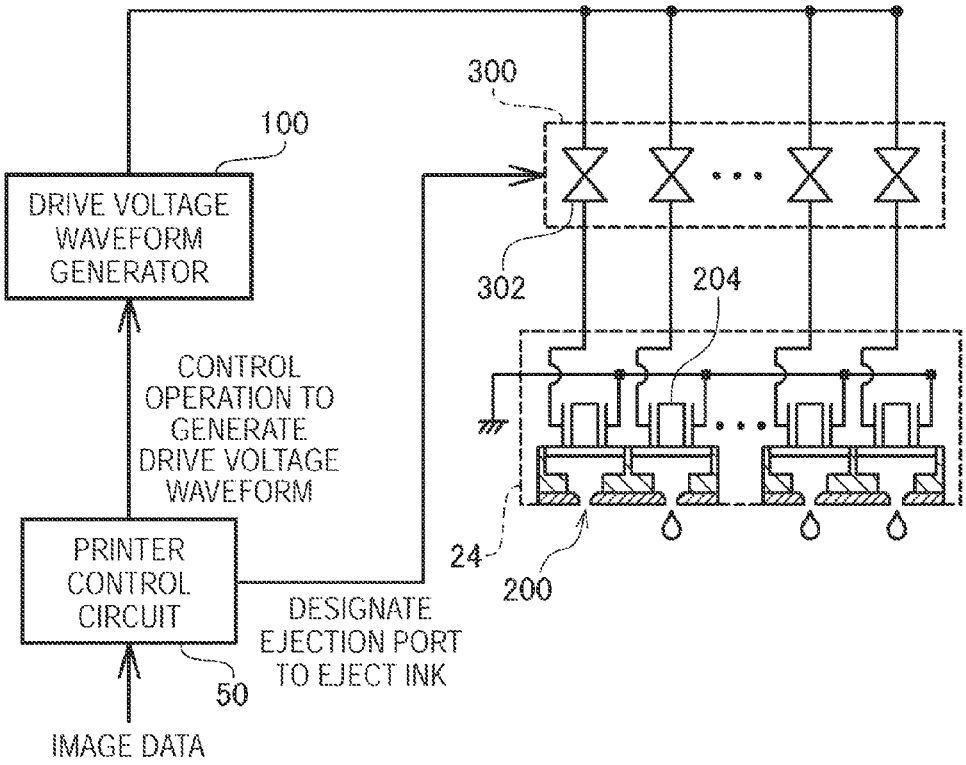
FIG. 4 is an explanatory view showing the configuration of the drive voltage waveform generator and its peripheral circuit provided in the inkjet printer of the embodiment.

FIG. 4 is an explanatory view showing the configuration of the drive voltage waveform generator and its peripheral circuit provided in the inkjet printer of the embodiment. Although the detailed configuration of the drive voltage waveform generator 100 will be described later, the drive voltage waveform generator 100 roughly includes a power supply generating a voltage and a waveform generating section generating a voltage waveform by changing the voltage from the power supply. The operation of the drive voltage waveform generator 100 is controlled by the printer control circuit 50. The printer control circuit 50 can generate a target drive voltage waveform by controlling the drive voltage waveform generator 100.

As shown in the drawing, output of the drive voltage waveform generator 100 is connected to a gate unit 300. The gate unit 300 includes a plurality of gate elements 302 connected in parallel. The piezo element 204 is connected to each of the gate elements 302. The gate elements 302 can be individually brought into a conductive state or a disconnection state. When only the gate element 302 of an ejection port from which ink is desired to be ejected is brought into the conductive state, a drive voltage waveform can be applied only to the corresponding piezo element 204, so that an ink drop can be ejected from the ejection port 200.

The printer control circuit 50 uses the circuit configuration described above to print an image as follows. First, based on image data desired to be printed, the printer control circuit 50 determines the ejection port 200 to eject an ink drop and the size of an ink drop to be ejected. According to the size of the ink drop to be ejected, the printer control circuit 50 determines a drive voltage waveform for ejecting the ink drop of the size. The printer control circuit 50 sends a command to the gate unit 300 to bring the gate element 302 corresponding to the ejection port 200 into the conductive state and causes the drive voltage waveform generator 100 to operate to generate the target drive voltage waveform. The thus generated drive voltage waveform is applied to the piezo element 204 of the target ejection port 200 via the gate element 302. As a result, the ink drop of the target size is ejected from the target ejection port 200.

In this case, for miniaturizing the configuration of the circuit generating such a drive voltage waveform, a circuit (so-called charge pump circuit) that changes a voltage by connecting in series or disconnecting charged capacitors is preferably used to generate the drive voltage waveform as described above. In a typical charge pump circuit, however, since the number of kinds of voltage values that can be output is limited to the number of capacitors, it is difficult to generate a highly accurate drive voltage waveform. On the other hand, when attempting to output many kinds of voltages by providing a number of capacitors, it is difficult this time to miniaturize the circuit configuration because the number of capacitors increases. Therefore, in the drive voltage waveform generator 100 of the embodiment, the following circuit configuration is employed, so that the number of voltages that can be output can be increased to generate a highly accurate drive voltage waveform while reducing the number of capacitors.

B. Drive Voltage Waveform Generator of Embodiment

Figure 5:
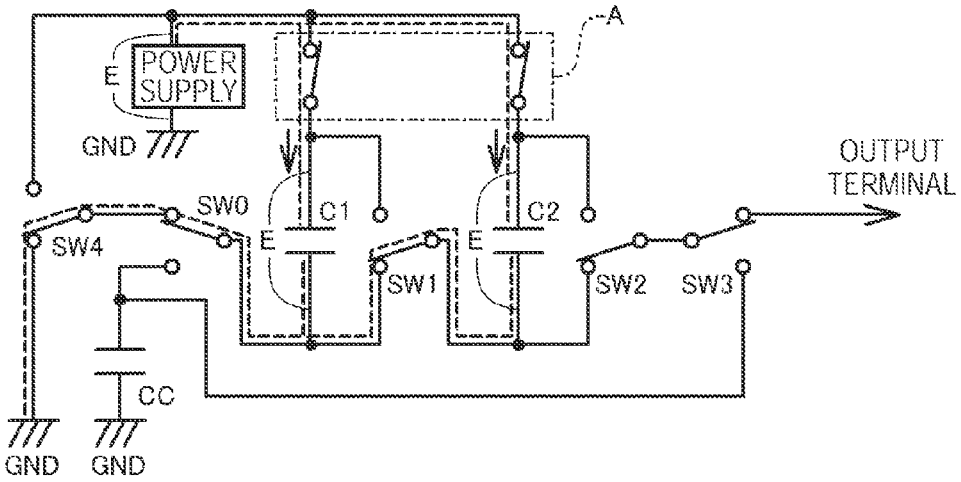
FIG. 5 is an explanatory view showing the configuration of the drive voltage waveform generator of the embodiment.

FIG. 5 is an explanatory view showing the configuration of the drive voltage waveform generator of the embodiment. As shown in the drawing, the drive voltage waveform generator 100 includes a power supply, capacitors C1 and C2, a capacitor CC, and switches that connect them. The capacitor C1 and the capacitor C2 can be connected to the power supply via switches indicated as "A" in the drawing. By connecting the capacitor C1 and the capacitor C2 to the power supply, they can be charged to the same voltage (voltage indicated as "E" in the drawing) as that of the power supply. The switches and the power supply are manipulated by the printer control circuit 50. The printer control circuit 50 can control the operation of the drive voltage waveform generator 100 by manipulating the switches and the power supply (refer to FIG. 4).

The capacitors C1 and C2 and the power supply, which constitute a so-called charge pump circuit, can be connected in series or disconnected to each other by switching the switches. In the drive voltage waveform generator 100 of the embodiment, the charge pump circuit is used to output a plurality of kinds of voltages as follows.

Figure 6A:
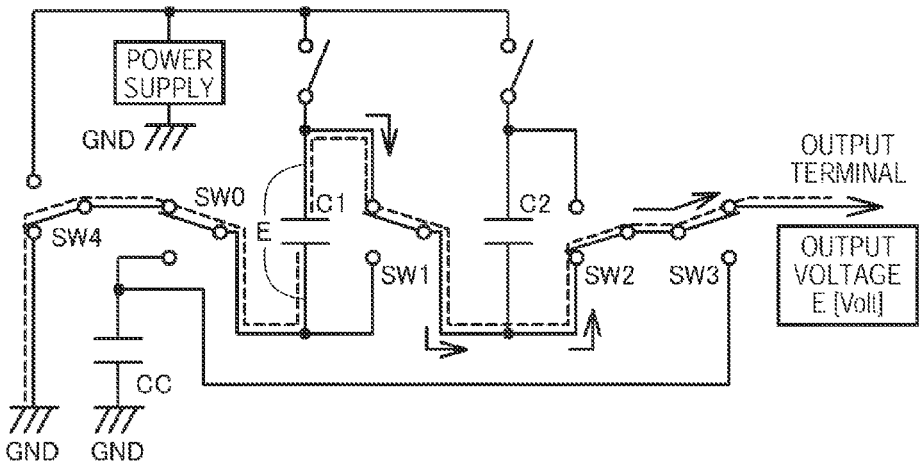
FIGS. 6A to 6C are explanatory views showing a state of outputting various voltages using a charge pump circuit of the drive voltage waveform generator of the embodiment.
Figure 6B:
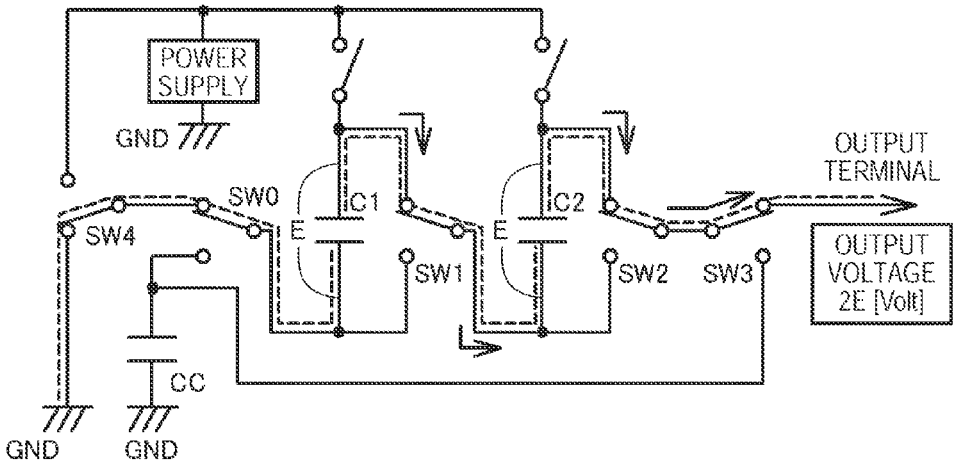
Figure 6C:
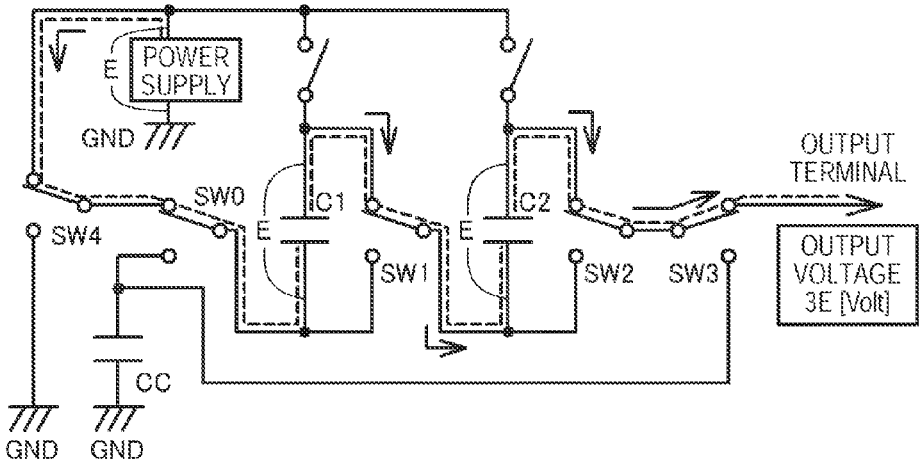

FIGS. 6A to 6C are explanatory views showing a state of outputting various voltages using the charge pump circuit of the drive voltage waveform generator of the embodiment. FIG. 6A shows a state of outputting the same voltage (voltage indicated as "E" in the drawing) as a voltage charged to the capacitor C1. As shown in the drawing, a switch SW1 is switched to the upper side of FIG. 6A, a switch SW2 is switched to the lower side of FIG. 6A, and a switch SW3 is switched to the upper side of FIG. 6A. Then, since the capacitor C1 is connected to an output terminal, the same voltage (voltage indicated as "E" in the drawing) as that of the capacitor C1 is output from the output terminal.

Moreover as shown in FIG. 6B, the switch SW2 is switched to the upper side of FIG. 6B in the state of FIG. 6A. This time, the capacitor C1 and the capacitor C2 can be connected to the output terminal while the capacitors are connected in series. By doing this, since the voltage of the capacitor C2 is added to the voltage of the capacitor C1, a voltage of "2E" can be output from the output terminal.

Further as shown in FIG. 6C, when a switch SW4 is switched to the upper side of FIG. 6C so that the switch SW4 is connected to the power supply in the state of FIG. 6B, also the power supply can be connected in series to the capacitor C1 and the capacitor C2 that are connected in series. By doing this, since also the voltage "E" of the power supply is added to the total voltage "2E" of the capacitor C1 and the capacitor C2, a voltage of "3E" can be output. In this manner, the drive voltage waveform generator 100 of the embodiment can output a plurality of kinds of voltages using the charge pump circuit composed of the capacitors C1 and C2 and the power supply.

However, since the number of voltages that can be output is limited when only the charge pump circuit is used, it is difficult to generate a highly accurate drive voltage waveform. As shown in FIG. 5 or FIGS. 6A to 6C, therefore, the drive voltage waveform generator 100 of the embodiment includes the capacitor CC in addition to the power supply and the capacitors C1 and C2. The capacitor CC is charged using the charge pump circuit composed of the capacitors C1 and C2 and the power supply, and the charged capacitor CC is used in a combination of the capacitors C1 and C2 and the power supply. Therefore, more kinds of voltages can be output in addition to the above-described voltages. This will be described with reference to FIGS. 7A to 7C.

Figure 7A:
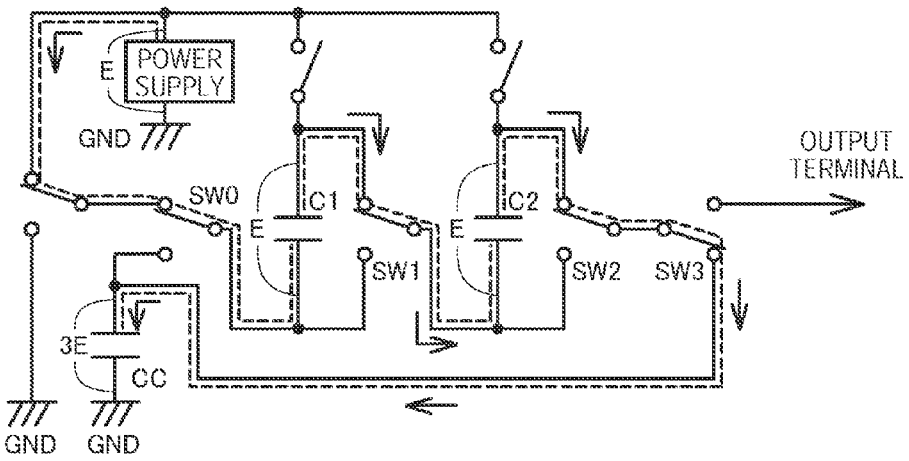
FIGS. 7A to 7C are explanatory views showing a state in which many kinds of voltages can be output using a capacitor CC.
Figure 7B:
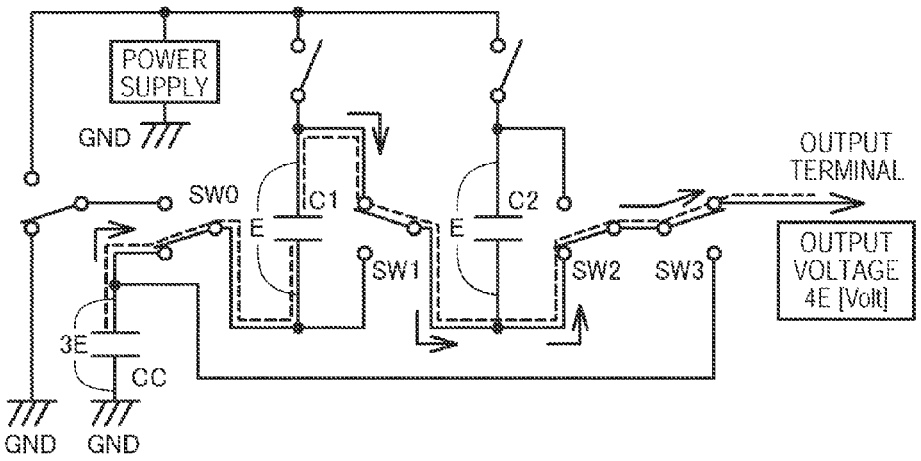
Figure 7C:
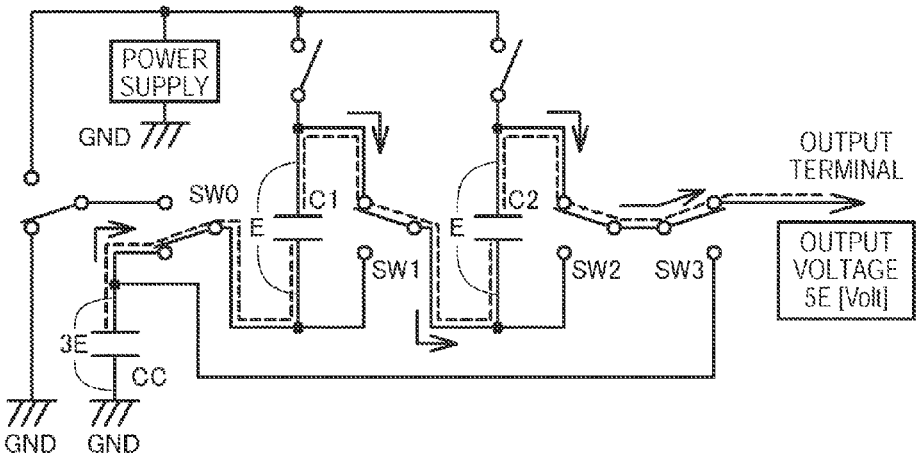

FIGS. 7A to 7C are explanatory views showing a state in which many kinds of voltages can be output using the capacitor CC. FIG. 7A shows a state of charging the capacitor CC. As shown in the drawing, in charging the capacitor CC, the capacitors C1 and C2 and the power supply constituting the charge pump circuit are connected in series, and the switch SW3 is manipulated to switch output of the charge pump circuit from the output terminal side to the capacitor CC side. Thus, the output of the charge pump circuit is applied to the capacitor CC, so that the capacitor CC is charged.

In this case, since the capacitor CC is charged with a voltage boosted by the charge pump circuit, the voltage of the capacitor CC after charging is different from the voltage of the power supply (or the voltage of the capacitors C1 and C2). In the example of FIG. 7A for example, the capacitor CC is charged with the voltage of "3E" boosted by the charge pump circuit, and therefore has the voltage "3E" after charging, which is different from the voltage "E" of the power supply and the capacitors C1 and C2. Viewed from another perspective, this fact means that the capacitor CC after charging serves as a new voltage source that generates a voltage different from that of the power supply (or the capacitors C1 and C2).

Accordingly, when the capacitor CC is used in a combination of the power supply or the capacitor C1 or C2, it is possible to output a voltage different from that obtained when only the capacitors C1 and C2 and the power supply are used (refer to FIGS. 6A to 6C). That is, as shown in FIG. 7B, when the capacitor CC is connected in series with respect to the capacitor C1, the voltage of "4E" can be output because the capacitor CC is charged to "3E". Further as shown in FIG. 7C, when the capacitor C1 and the capacitor C2 are connected in series to the capacitor CC while the capacitors C1 and C2 are connected in series, the voltage of "5E" can be output because the capacitor CC is charged to the voltage "3E".

In the drive voltage waveform generator 100 of the embodiment in this manner, the capacitor CC is charged by the charge pump circuit, and the capacitor CC is connected in series to the power supply or the capacitor C1 or C2. Therefore, a plurality of kinds of voltages can be further output in addition to the voltages (refer to FIGS. 6A to 6C) that can be output using the charge pump circuit. This becomes possible because the capacitor CC is charged to a voltage different from that of the power supply or the capacitor C1 or C2 as described above. This will be supplementary described with reference to FIG. 8.

Figure 8:
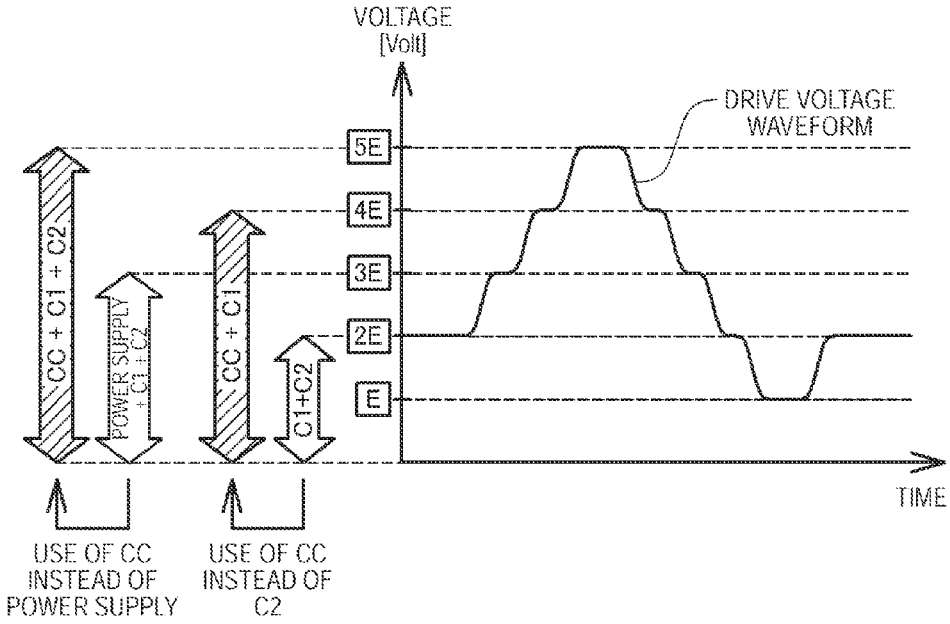
FIG. 8 is an explanatory view conceptually showing a state in which many kinds of voltages can be output by the drive voltage waveform generator of the embodiment.

FIG. 8 is an explanatory view conceptually showing a state in which many kinds of voltages can be output by the drive voltage waveform generator of the embodiment. On the left of the graph in the drawing, the voltage value that can be output by the drive voltage waveform generator 100 of the embodiment is shown. Open arrows in the drawing represent the voltage value that can be output when the power supply and the capacitors C1 and C2 are used, while hatched arrows represent the voltage value that can be newly output using the capacitor CC.

In a charge pump circuit in general, since a plurality of capacitors are charged to the same voltage, the value of voltage to be output is determined by the number of capacitors connected in series. Therefore, when the number of capacitors connected in series is the same, the value of voltage to be output is the same even which of the capacitors is used. Even when the capacitor to be connected in series is replaced by another capacitor, it is impossible to output a different voltage value to increase the number of voltages that can be output. In view of this, the capacitor CC is charged to a voltage different from that of the capacitor C1 or C2 or the power supply in the drive voltage waveform generator 100 of the embodiment. By doing this, a voltage obtained when the capacitor C1 and the capacitor C2 are connected in series (voltage indicated as "2E" in the drawing) is different from a voltage obtained when the capacitor CC is used instead of the capacitor C2 (voltage indicated as "4E" in the drawing). Therefore, by using the capacitor CC instead of the capacitor C2, it is possible to output a new voltage to increase the number of voltages that can be output.

Moreover, in the case of outputting a voltage using a charge pump circuit, it is possible to use, in addition to a capacitor, a power supply that charges a capacitor. In such a case, however, since the capacitor is charged by the power supply, the voltage of the power supply is the same as that of the capacitor. Therefore, when either the capacitor or the power supply is used, the voltage to be output is the same. Accordingly, even when the capacitor and the power supply are separately used, it is impossible to increase the number of voltages that can be output. In the drive voltage waveform generator 100 of the embodiment, on the other hand, the voltage of the power supply is different from that of the capacitor CC. Therefore, a voltage obtained when the capacitor C1, the capacitor C2, and the power supply are connected in series (voltage indicated as "3E" in the drawing) is different from a voltage obtained when the capacitor CC is used instead of the power supply (voltage indicated as "5E" in the drawing). Accordingly, the use of the capacitor CC instead of the power supply makes it possible to output a new voltage to increase the number of voltages that can be output.

On the right of FIG. 8, a drive voltage waveform generated using the voltages that can be output as described above is illustrated. In the drive voltage waveform generator 100 of the embodiment, since many kinds of voltages can be output, the voltage can be changed in small steps as shown in the drawing, making it possible to generate a highly accurate drive voltage waveform. Thus, in the inkjet printer 10 of the embodiment, a highly accurate drive voltage waveform can be applied to the piezo element disposed at the ejection port 200. As a result, it is possible to accurately control the piezo element to properly eject an ink drop.

In the drive voltage waveform generator 100 of the embodiment, it is also possible to reduce the number of capacitors to miniaturize the circuit configuration. That is, in the drive voltage waveform generator of the embodiment, the output voltage is different between when the capacitor CC is used and when the capacitor CC is not used, as described above. Therefore, even when the number of capacitors connected in series is the same, two types of voltages can be output. Therefore, by providing the capacitor CC, it is possible to output roughly twice as many kinds of voltages as the number of capacitors provided in the charge pump circuit. Therefore, it is not necessary to greatly increase the number of capacitors, and it is possible to reduce the number of capacitors to miniaturize the circuit configuration.

In the drive voltage waveform generator 100 of the embodiment, since the capacitor CC can be charged to a voltage higher than that of the other capacitors, it is also possible to reduce the number of capacitors connected in series for outputting a voltage. That is, since the capacitor CC is charged to a voltage higher than that of the other capacitors, the number of capacitors connected in series can be reduced by the amount of voltage of the capacitor CC when the capacitor CC is used. In the example shown in FIG. 7B for example, a voltage four times the voltage of the capacitor of the charge pump circuit is output. However, it is not necessary for outputting the four-times voltage to connect four capacitors in series, but two capacitors of the capacitor CC and the capacitor C1 are connected in series.

In general, since the overall capacitance of capacitors is reduced when the capacitors are connected in series, the capacitance of the individual capacitors has to be increased previously when a number of capacitors are connected in series. In view of this, since the number of capacitors connected in series can be reduced in the drive voltage waveform generator of the embodiment, the capacitance of the individual capacitors can be suppressed to a small value. Further, it is also possible to further miniaturize the circuit configuration using smaller capacitors. Moreover, since it is possible to reduce the number of switches that connect between the capacitors, the circuit configuration can be more simplified. Consequently, power consumption due to the internal resistance of switch can be reduced to improve power efficiency.

In charging the capacitor CC (refer to FIG. 7A), the capacitor CC may not be sufficiently charged due to a decreased voltage of the capacitor C1 and the capacitor C2. In such a case, the capacitor C1 and the capacitor C2 are charged again by the power supply, and thereafter the capacitor C1 and the capacitor C2 are connected to the capacitor CC again. With the repetition of this operation, the capacitor CC can be sufficiently charged.

As described above, in the drive voltage waveform generator 100 of the embodiment, the capacitor CC is charged to a voltage different from that of the power supply or the capacitor C1 or C2 and used, so that it is possible to output many kinds of voltages to generate a highly accurate drive voltage waveform without greatly increasing the number of capacitors. Because of this, the circuit configuration can be miniaturized, and power consumption due to the switches or the like that connect between the capacitors can be reduced to enhance power efficiency.

C. Modified Examples

Hereinafter, modified examples of the above-described embodiment will be described. In the following modified examples, the same constituents as those of the embodiment are denoted by the same reference and numeral signs as those of the embodiment, and the detailed description thereof is omitted.

C-1. First Modified Example

In the drive voltage waveform generator of the above-described embodiment, the output voltage of the capacitor CC is combined with the output voltage of the capacitor C1 and the capacitor C2 to output from the output terminal (refer to FIGS. 7B and 7C). However, the output voltage of the capacitor CC may be output as it is from the output terminal without combining with the output voltage of the capacitor C1 or the capacitor C2.

Figure 9:
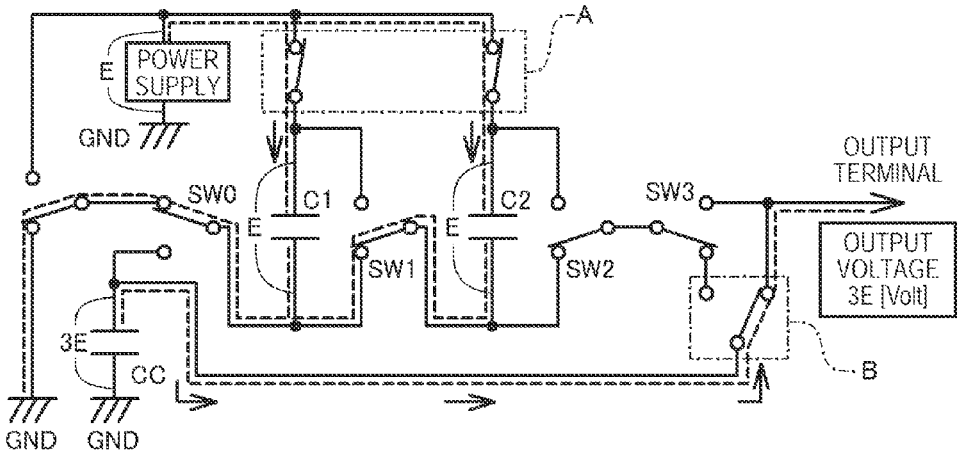
FIG. 9 is an explanatory view showing a drive voltage waveform generator of a first modified example in which the voltage of the capacitor CC is directly output to an output terminal.

FIG. 9 is an explanatory view showing a drive voltage waveform generator of a first modified example in which the voltage of the capacitor CC is directly output to the output terminal. As shown in the drawing, the capacitor CC can be connected to the output terminal via a switch indicated as "B" in the drawing, and the voltage of the capacitor CC can be directly output from the output terminal without the capacitor C1 or the capacitor C2. With this configuration, the capacitor C1 and the capacitor C2 do not have to output a voltage while a voltage is output from the capacitor CC to the output terminal, during which the capacitor C1 and the capacitor C2 can be charged by manipulating the switches indicated as "A" in the drawing. By doing this, even when the voltage of the capacitor C1 and the capacitor C2 decreases while the drive voltage waveform is output, the capacitor C1 and the capacitor C2 can be recharged while the capacitor CC is used. Therefore, it is possible to omit the time for recharging the capacitor C1 and the capacitor C2 and to output a drive voltage waveform more quickly.

As described above with reference to FIG. 3, in the inkjet printer 10, a fixed voltage (voltage indicated as "initial voltage" in FIG. 3) is previously applied to the piezo element 204. Therefore, when the capacitor CC is previously charged to the initial voltage, the initial voltage can be applied to the piezo element 204 using the capacitor CC. By doing this, the capacitor C1 or the capacitor C2 can be charged to provide for output of a drive voltage waveform while the initial voltage is applied, which is more preferable. Moreover, since it is not necessary to separately prepare a power supply for applying the initial voltage, the device configuration can be further miniaturized.

C-2. Second Modified Example

While a voltage is output from the capacitor CC to the output terminal, not only the capacitor C1 or the capacitor C2 but also the capacitor CC can be charged.

Figure 10:
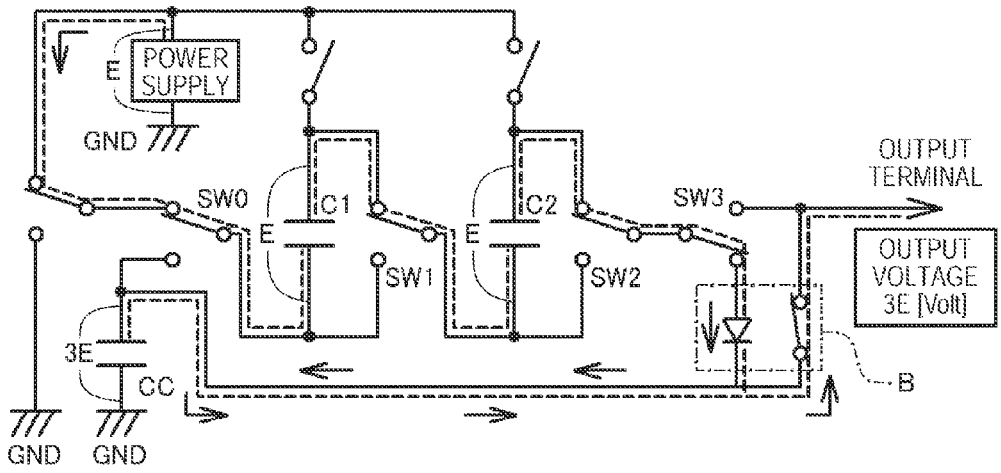
FIG. 10 is an explanatory view showing a drive voltage waveform generator of a second modified example in which the capacitor CC can be charged while a voltage is output from the capacitor CC.

FIG. 10 is an explanatory view showing a drive voltage waveform generator of a second modified example in which the capacitor CC can be charged while a voltage is output from the capacitor CC. As shown in the drawing, in the drive voltage waveform generator of the second modified example, the capacitor CC is connected to the output terminal, and output of the charge pump circuit composed of the power supply and the capacitors C1 and C2 is supplied to the capacitor CC via a diode (refer to the portion indicated as "B" in the drawing). By doing this, when a voltage is output from the capacitor CC, and the voltage of the capacitor CC is decreased, power is supplied from the charge pump circuit to the capacitor CC via the diode. Therefore, the capacitor CC can be charged while the voltage is output from the capacitor CC.

C-3. Third Modified Example

In the drive voltage waveform generator 100 of the above-described embodiment, it is possible to separately use the power supply and the capacitor CC by switching a switch SW0 (refer to FIGS. 6C and 7C). However, it is possible not only to separately use the capacitor CC and the power supply but also to connect them in series to simultaneously use both of them.

Figure 11:
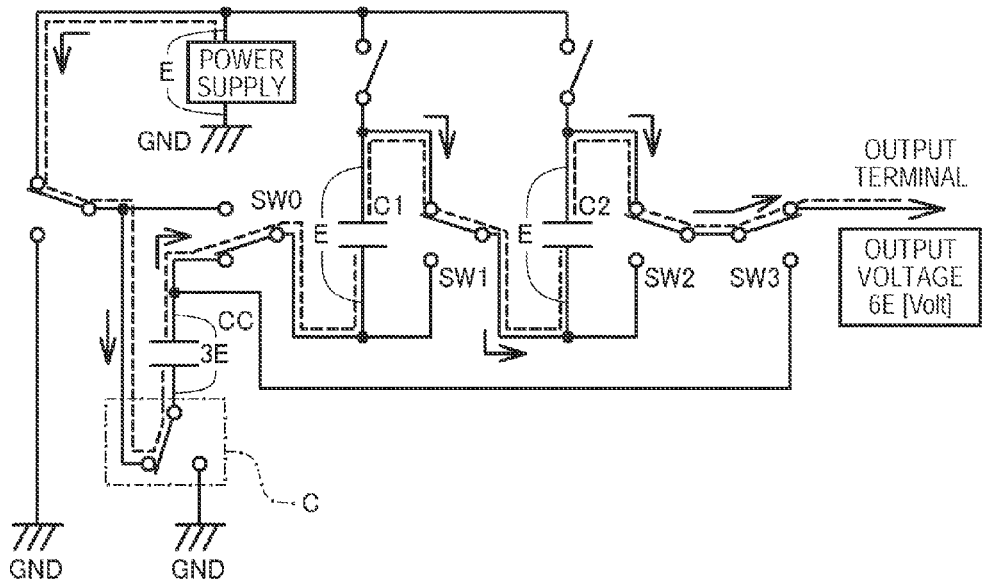
FIG. 11 is an explanatory view showing a drive voltage waveform generator of a third modified example in which the capacitor CC and a power supply can be connected in series.

FIG. 11 is an explanatory view showing a drive voltage waveform generator of a third modified example in which the capacitor CC and the power supply can be connected in series. As shown in the drawing, in the drive voltage waveform generator of the third modified example, the capacitor CC and the power supply can be connected in series by switching a switch indicated as "C" in the drawing. When the drive voltage waveform generator is configured as described above, a voltage obtained by adding up the voltages of the power supply and all the capacitors (voltage indicated as "6E" in the drawing in the example of FIG. 11) can be output. Therefore, it is possible to further increase the number of voltages that can be output.

C-4. Fourth Modified Example

In the drive voltage waveform generator of the above-described embodiment, the capacitor CC is charged to the same voltage as the output voltage of the charge pump circuit. However, the capacitor CC can simply be charged to a voltage different from that of the power supply and the capacitors C1 and C2 and is not necessarily be charged to the same voltage as the output voltage of the charge pump circuit.

Figure 12A:
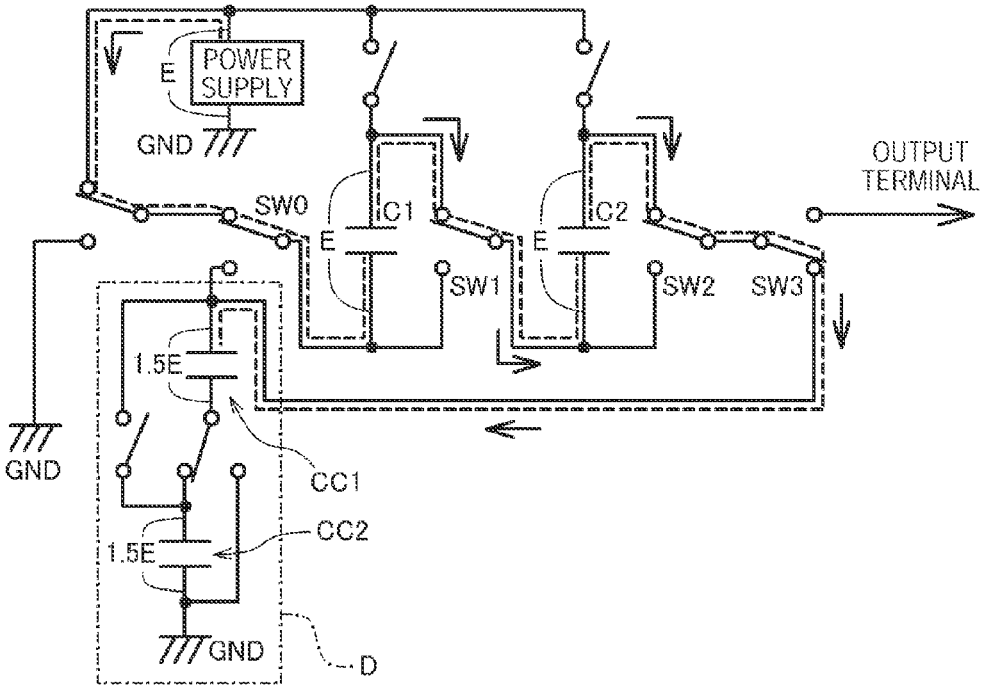
FIGS. 12A and 12B are explanatory views illustrating a drive voltage waveform generator of a fourth modified example in which the capacitor CC is charged to a voltage different from the output voltage of the charge pump circuit.
Figure 12B:
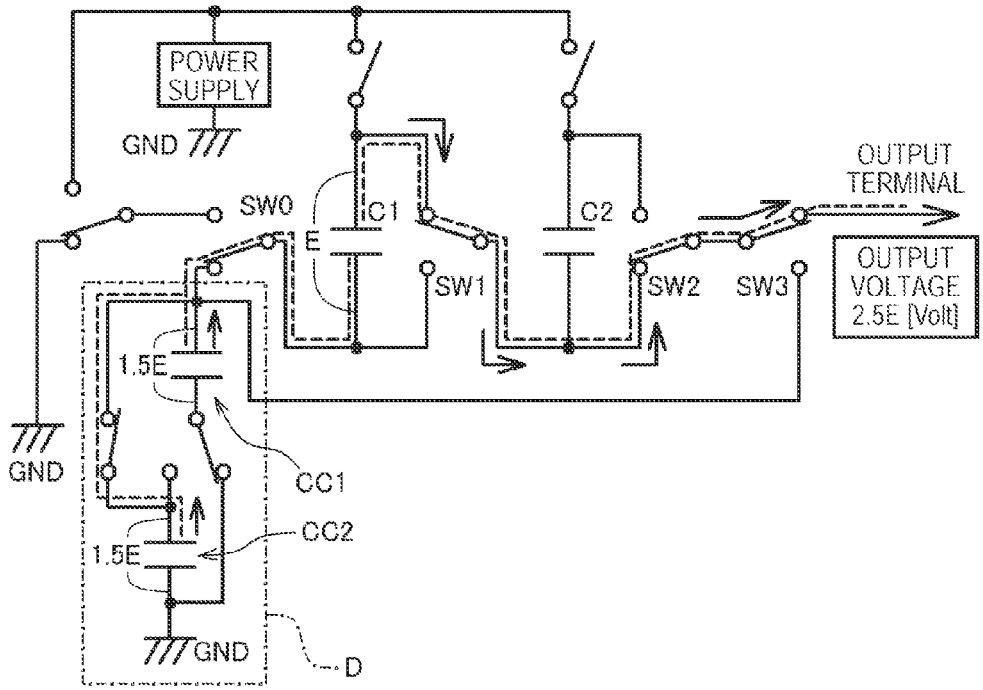

FIGS. 12A and 12B are explanatory views illustrating a drive voltage waveform generator of a fourth modified example in which the capacitor CC is charged to a voltage different from the output voltage of the charge pump circuit. As shown in FIG. 12A, in the drive voltage waveform generator of the fourth modified example, two capacitors of a capacitor CC1 and a capacitor CC2 can be connected in series (refer to the portion indicated as "D" in the drawing), and these capacitors can be charged by the charge pump circuit while the two capacitors are connected in series. Therefore, each of the two capacitors is charged to a voltage half the output voltage of the charge pump circuit (voltage indicated as "1.5E" in the drawing). Since the voltage of the capacitor CC1 (or the capacitor CC2) is different from that of the power supply and the capacitors C1 and C2, many kinds of voltages can be output by combining the capacitor C1 or C2 or the power supply with the capacitor CC1 (or the capacitor CC2).

In the case of outputting a voltage using the capacitor CC1 and the capacitor CC2, the capacitor CC1 and the capacitor CC2 may be used while the capacitors CC1 and CC2 are connected in parallel as shown in FIG. 12B. By doing this, since the overall capacitance of the capacitor CC1 and the capacitor CC2 can be increased, a larger amount of power can be supplied. Moreover, the frequency of charging the capacitor CC1 and the capacitor CC2 can be reduced to generate a drive voltage waveform more quickly.

C-5. Fifth Modified Example

In the above-described embodiment and modified examples, for connecting the charge pump circuit and the capacitor CC to the output terminal while they are connected in series, the charge pump circuit is connected to the output terminal side, and the capacitor CC is connected to the GND side (refer to FIG. 7C). Contrary to this, however, the charge pump circuit may be connected to the GND side, and the capacitor CC may be connected to output terminal side.

Figure 13:
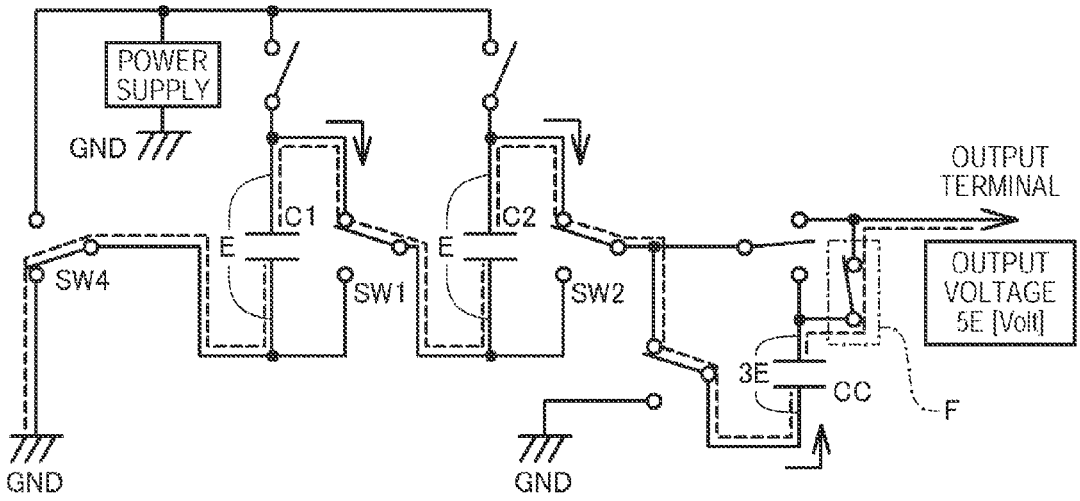
FIG. 13 is an explanatory view illustrating a drive voltage waveform generator of a fifth modified example in which the charge pump circuit is connected to the GND side and the capacitor CC is connected to the output terminal side.

FIG. 13 is an explanatory view showing a drive voltage waveform generator of a fifth modified example in which the charge pump circuit is connected to the GND side, and the capacitor CC is connected to the output terminal side. As shown in the drawing, in the drive voltage waveform generator 100 of the fifth modified example, the capacitor CC can be connected to the output terminal via a switch indicated as "F" in the drawing, and the charge pump circuit can be connected to the GND via the switch SW4. Therefore, in the state in which the charge pump circuit and the capacitor CC are connected in series, the capacitor CC is connected to the side of the output terminal, and the charge pump circuit is connected to the side of the GND.

By doing this, since the charge pump circuit is connected to the GND, even when the charge pump circuit and the capacitor CC are connected in series to output a high voltage, the voltage applied to the switches of the charge pump circuit can be suppressed at a low level. In the example of FIG. 13 for example, a voltage having a voltage value of "5E" can be output by connecting the charge pump circuit and the capacitor CC in series. However, since the charge pump circuit is connected to the GND, the voltage applied to the switch SW1 can be suppressed to "E" corresponding to the voltage of one capacitor. Similarly, the voltage applied to the switch SW2 is suppressed to "2E" corresponding to the voltage of two capacitors. In this manner, by connecting the charge pump circuit to the side of the GND, the voltage applied to the switches of the charge pump circuit can be suppressed at a low level. Therefore, switches having low resistance to voltage (withstand voltage) can be used for the switches of the charge pump circuit. As a result, the circuit configuration of the drive voltage waveform generator 100 can be more simplified using the switches having low withstand voltage. Further, since the use of the switches having low withstand voltage makes it possible to simplify the circuit controlling the switches, the circuit configuration of the printer control circuit 50 (refer to FIG. 4) controlling the switches can also be simplified.

While the inkjet printer on which the drive voltage waveform generator of the embodiment is mounted has been described, the invention is not limited to the embodiment and modified examples but can be implemented in various modes within a range not departing from the gist thereof. For example, the drive voltage waveform generator of the embodiment may be mounted on a printing apparatus provided with a larger ejection head (so-called line head printer etc.). In such a printing apparatus, since many drive elements are mounted with a larger ejection head, the circuit configuration for generating a drive voltage waveform tends to be large. In view of this, the use of the drive voltage waveform generator of the embodiment makes it possible to miniaturize the circuit configuration.

Although the above-described embodiment has been described about the case where the drive voltage waveform generator of the embodiment is applied to the drive circuit of the piezo element in the inkjet printer, the drive voltage waveform generator of the embodiment can be applied to various devices driven according to a voltage. For example, the drive voltage waveform generator can be applied to display devices that can be operated by a voltage, such as a liquid crystal panel or an organic EL panel. Moreover, in a fluid ejection device as a surgical instrument for incision or excision of living tissues by ejecting liquid such as water or saline solution in pulses, the drive voltage waveform generator can be applied to a pulsating flow generating device that drives a piezo element to change the volume of a liquid chamber, thereby converting liquid into pulse-like pulsating flow. Even when driving such a device, it is possible to accurately operate various elements such as a liquid crystal element or an organic EL element because many kinds of voltages can be output. Moreover, since many kinds of voltages can be output, the number of gradation values of display devices can also be increased. The drive voltage waveform generator can of course drive accurately, not limited to display devices, but any device as long as it can be driven by a voltage because many kinds of voltages can be output.

This application claims priority to Japanese Patent Application No. 2009-188940, filed on Aug. 18, 2009, the entirety of which is hereby incorporated by reference.

What is claimed is:

1. A load driving circuit that applies a voltage to a load to drive the load, comprising:

a plurality of first storage elements that are charged by receiving a supply of voltage from a power supply;

a series storage element group constituting unit that switches a connection state between the plurality of first storage elements to constitute a series storage element group in which the first storage elements are connected in series;

a second storage element charging unit that charges a second storage element different from the first storage elements using the series storage element group; and a voltage applying unit that switches between a first connection state and a second connection state to apply a voltage to the load, the first connection state being a state in which the charged second storage element and the series storage element group are connected to the load while the second storage element and the series storage element group are connected in series, the second connection state being a state in which the series storage element group is connected to the load while the series connection between the second storage element and the series storage element group is broken.

2. The load driving circuit according to claim 1, further comprising a second storage element connecting unit that connects the second storage element to the load while the series storage element group is disconnected from the load, wherein the first storage elements receive a supply of voltage from the power supply while the second storage element is connected to the load.

3. A liquid ejection device comprising:

the load driving circuit according to claim 1;

an ejection nozzle that ejects liquid; and an actuator that is connected to the load driving circuit as the load and driven by the load driving circuit to eject the liquid from the ejection nozzle.

4. A load driving circuit that applies a voltage to a load to drive the load, comprising:

a first storage element that is charged by receiving a supply of voltage from a power supply;

a second storage element that is charged by receiving a supply of voltage from the power supply;

a series storage element group constituting unit that constitutes a series storage element group in which the first storage element and the second storage element are connected in series;

a third storage element charging unit that charges a third storage element different from the first storage element and the second storage element using the series storage element group; and a voltage applying unit that switches between a first connection state and a second connection state to apply a voltage to the load, the first connection state being a state in which the charged third storage element and the series storage element group are connected to the load while the third storage element and the series storage element group are connected in series, the second connection state being a state in which the series storage element group is connected to the load while the series connection between the third storage element and the series storage element group is broken.

* * * * *